US005418319A

United States Patent [19]

Akiyama

[11] Patent Number: 5,418,319

[45] Date of Patent: May 23, 1995

[54] MUSIC BOX

[76] Inventor: Kenzo Akiyama, 405, 4-2, Kitakasai 4-chome, Edogawa-ku, Tokyo, Japan

[21] Appl. No.: 195,031

[22] Filed: Feb. 14, 1994

[30] Foreign Application Priority Data

Feb. 19, 1993 [JP] Japan ..... 5-053162

[51] Int. Cl.[6] ..... G10F 1/12

[52] U.S. Cl. ..... 84/83; 84/87; 84/97

[58] Field of Search ..... 84/83, 86, 87, 88, 89, 84/90, 91, 97, 98, 99, 100

[56] References Cited

U.S. PATENT DOCUMENTS

| | | | |
|---|---|---|---|
| 1,277,813 | 9/1918 | Zuehlke | 84/88 |
| 1,681,546 | 8/1928 | Maag | 84/83 |
| 3,602,189 | 8/1971 | Suzuki | 84/83 |
| 3,908,505 | 9/1975 | Ono | 84/83 |
| 3,982,459 | 9/1976 | Akiyama | 84/83 |
| 4,185,533 | 1/1980 | Akiyama et al. | 84/83 |

FOREIGN PATENT DOCUMENTS 53-27980 8/1978 Japan .

*Primary Examiner*—M. L. Gellner
*Assistant Examiner*—Eddie C. Lee
*Attorney, Agent, or Firm*—Sandler Greenblum & Bernstein

[57] ABSTRACT

A music box comprising a blower unit and a flute unit. Each flute in the flute unit includes a mouth and a wind inlet hole for feeding air to the mouth and the wind inlet holes for feeding air to the flute are selectively opened/closed to produce a desired melody. Further, an air outflow hole is provided in a wind trunk of the blower unit and a disk having holes for cyclically opening/closing the hole is rotatably provided. Thus the pressure of wind fed to each flute changes at a predetermined interval of time. As a member for recording a melody, the following two methods are available. One method is a disk having protrusions for pressing the key members of the flute unit and another method is a film member which opens/closes the air inlet hole of the flute unit.

7 Claims, 10 Drawing Sheets

MUSIC BOX

BACKGROUND OF THE INVENTION

1. Field of the Invention

The present invention relates to a music box which employs flutes and more particularly to a music box which is used in toys or fancy goods.

2. Description of the Prior Art

A music box of the prior art employing flutes includes a blower unit and a flute unit. The flute unit has wind inlet holes for feeding air to the flutes. The wind inlet holes being selectively opened and closed to produce a desired melody by key members. As a means for recording a melody, a disk containing protrusions for pressing the key members of the flute unit has been utilized.

U.S. Pat. No. 3,982,459, issued Sep. 28, 1976 discloses a music producing mechanism using flutes. The mechanism includes a fan which supplies air to wind chest coupled to the motor. This chest is utilized in conjunction with valve actuators and valves which control the release of air so as to create sound.

However, in this type of music producing mechanism, when wind is introduced wind to the flue to play a flute, the amount of fed air is large and constant, so that the tone of a generated sound is sharp and rigid. Thus, the development of a music box which is capable of generating a softer, more comfortable sound has been long desired for mounting the music box on toys or fancy goods.

SUMMARY OF THE INVENTION

Accordingly, an object of the present invention is to provide a music box which during automatic playing of a melody, generates vibrating sounds like tremolo having the same soft tone as a sound made when a person plays a pipe, the music box being suitable for being mounted on toys or fancy goods.

In accordance with the present invention, the above object is achieved by providing a music box comprising a blower unit, flute unit including a plurality of flutes having different musical scales, a wind trunk for introducing wind from the blower unit, a wind pressure control means for vibrating the wind pressure in the wind trunk and a wind feeding control means for selectively feeding wind to respective flutes.

A preferred example of the wind pressure control means is a combination of a hole made in the wall of the wind trunk and an opening/closing member for opening or closing the hole at a predetermined frequency. A preferred example of the wind feeding control means is a valve unit which opens or closes the wind trunk of each flute. Another preferred example of the wind feeding control means is a long film member which is wide enough to intercept the wind trunks and movable along the length, the long film member including a plurality of holes for opening the wind trunk of each flute.

DESCRIPTION OF THE PREFERRED EMBODIMENTS

Figure 1:
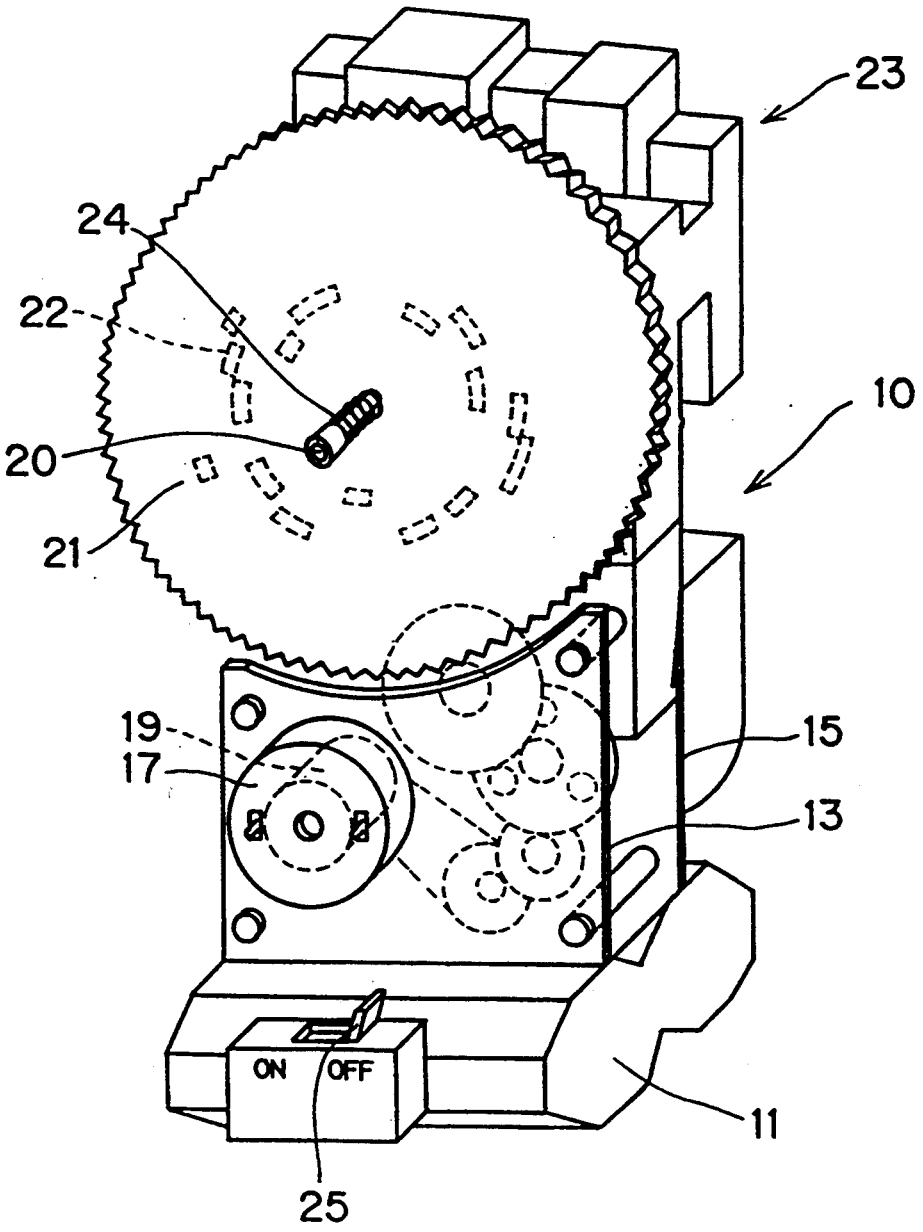
FIG. 1 is a front perspective view of an embodiment of the music box according to the present invention.

A music box 10 contains a gear train which are disposed between front and rear frames 13 and 15 standing vertically on a battery case 11. The case 11 have two batteries which are the power supply of the box 10. The gear train is driven by a motor 19. A motor case 17 fixed to the front frame 13 have the motor 19. A disk 21 and the flute unit 23 are attached to the frame 13 and 15. The disk 21 is rotatably fit to a spindle 20 having driven connection with the gear train. The flute unit 23 includes five flutes **23*a*, 23*b*, 23*c*, 23*d*, 23*e* on the upper stage and four flutes 23*f*, 23*g*, 23*h*, 23*i* on the lower stage. The five flutes on the upper stage have mouths 28*a*, 28*b*, 28*c*, 28*d*, 28*e* at the lower sections and the four flutes on the lower stage have mouths 28*f*, 28*g*, 28*h*, 28*i* at the upper sections (FIG. 2**).

The disk 21 has a plurality of projections 22 on the back surface and is urged toward the front face of the flute unit 23 by a spring 24. A power switch 25 is provided in front of the battery case 11.

Figure 2:
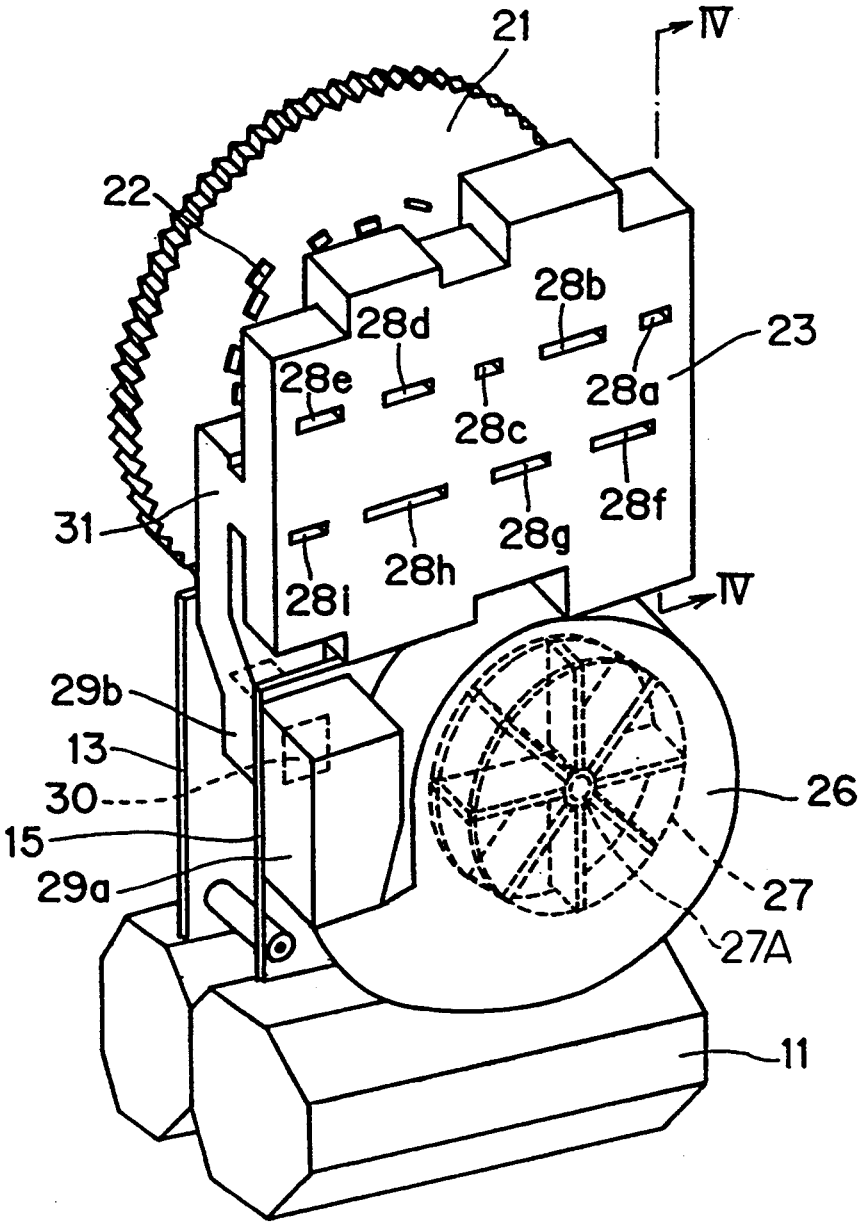
FIG. 2 is a rear perspective view of the music box shown in FIG. 1.

As shown in FIG. 2, a blower unit 26 includes a fan 27 rotatably fitting to a spindle 27A of the motor 19, and includes a wind trunk **29*a* for feeding wind generated in the fan 27**.

Further, a flute unit 23 is disposed above the fan 27 of the blower unit 26. The five mouths **28*a*, 28*b*, 28*c*, 28*d*, 28*e*** locates on the upper stage and the other four mouths are positioned on the lower stage. The nine mouths are arranged horizontally so that they are open.

Figure 3:
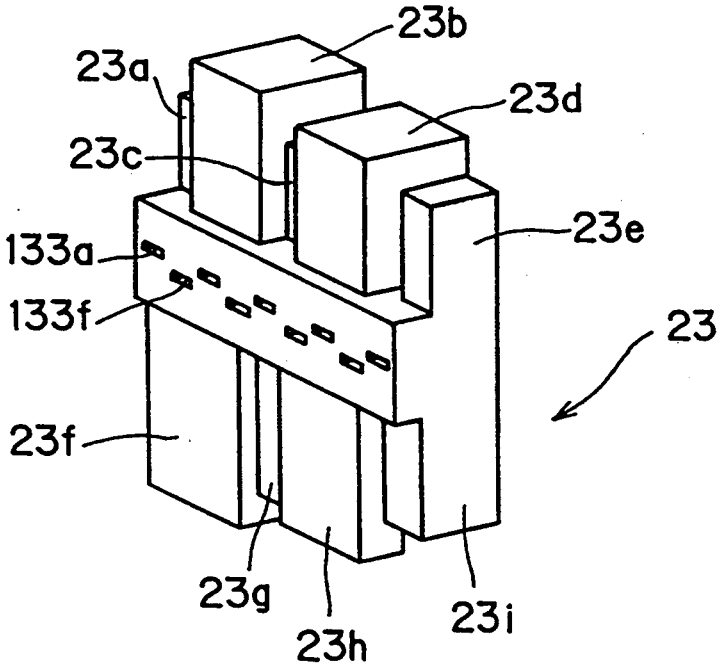
FIG. 3 is a front perspective view of the flute unit of the music box shown in FIG. 1.
Figure 4:
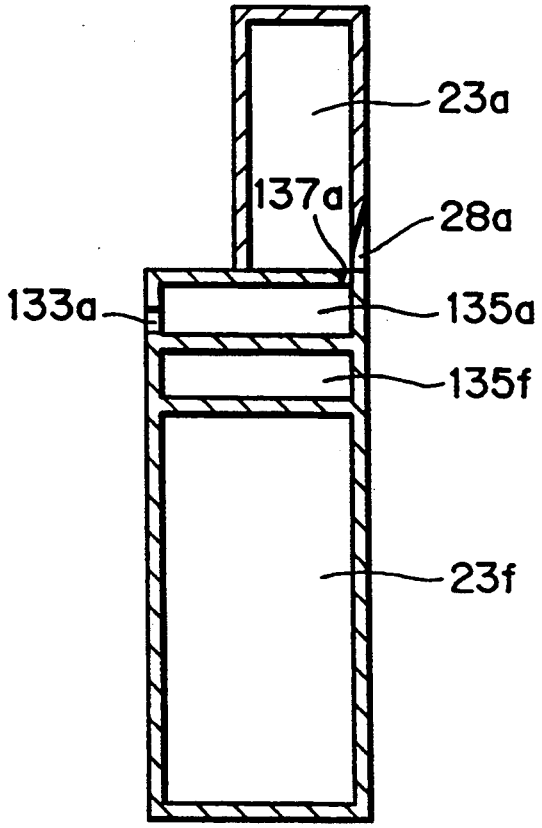
FIG. 4 is a sectional view of the flute unit shown in FIG. 3.

FIG. 3 is a perspective view showing the flute unit 23 and FIG. 4 is a sectional view thereof.

The flute unit 23 comprises five upper wind chests **135*a* . . . , and four lower wind chests 135*f* . . . , which are provided between the five flutes 23*a* through 23*e* on the upper stage and the four flutes 23*f* through 23*i*** on the lower stage.

Because the such flutes and the wind chests have the same construction, the construction is explained referring to the flute **23*a* and the upper wind chest 135*a* as illustrated in FIG. 4. The upper wind chest 135*a* is a space partitioned by rectangular parallelpiped walls extending horizontally and a flue 137*a* is open near the mouth 28*a* in the rear wall of the flute 23*a*. A wind inlet hole 133*a* is provided on the front wall of the upper wind chest 135*a***.

Each flute having the construction described above, is hollow and air/wind flowing through the flue **137*a* changes the air pressure inside. This air pressure changes the direction of wind flow along the edge of the mouth 28***a* to inside or outside alternately, thereby vibrating the internal space and the wall of the flute to generate a sound.

In the music box mounted on toys or fancy goods, the pressure of the wind generated by the motor 19 and the fan 27 may be less than about 6 cm when it is converted in terms of water pressure in order to achieve the purpose. Thus this box is preferable from economical viewpoints.

Figure 5:
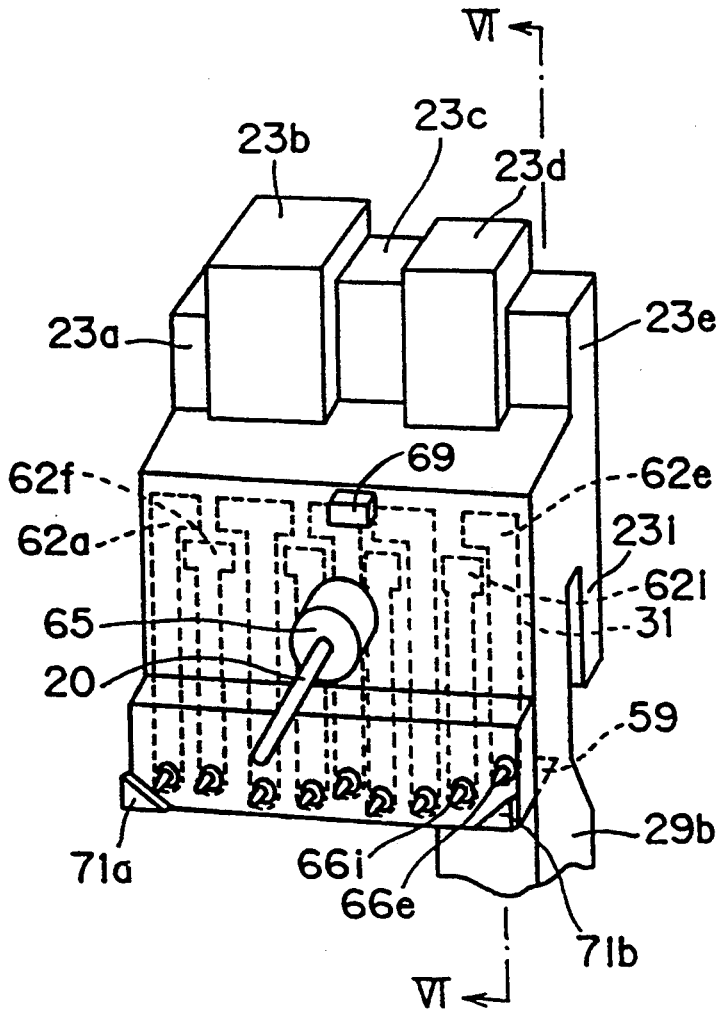
FIG. 5 is a partial perspective view of the music box shown in FIG. 1 from which a disk is removed.
Figure 6:
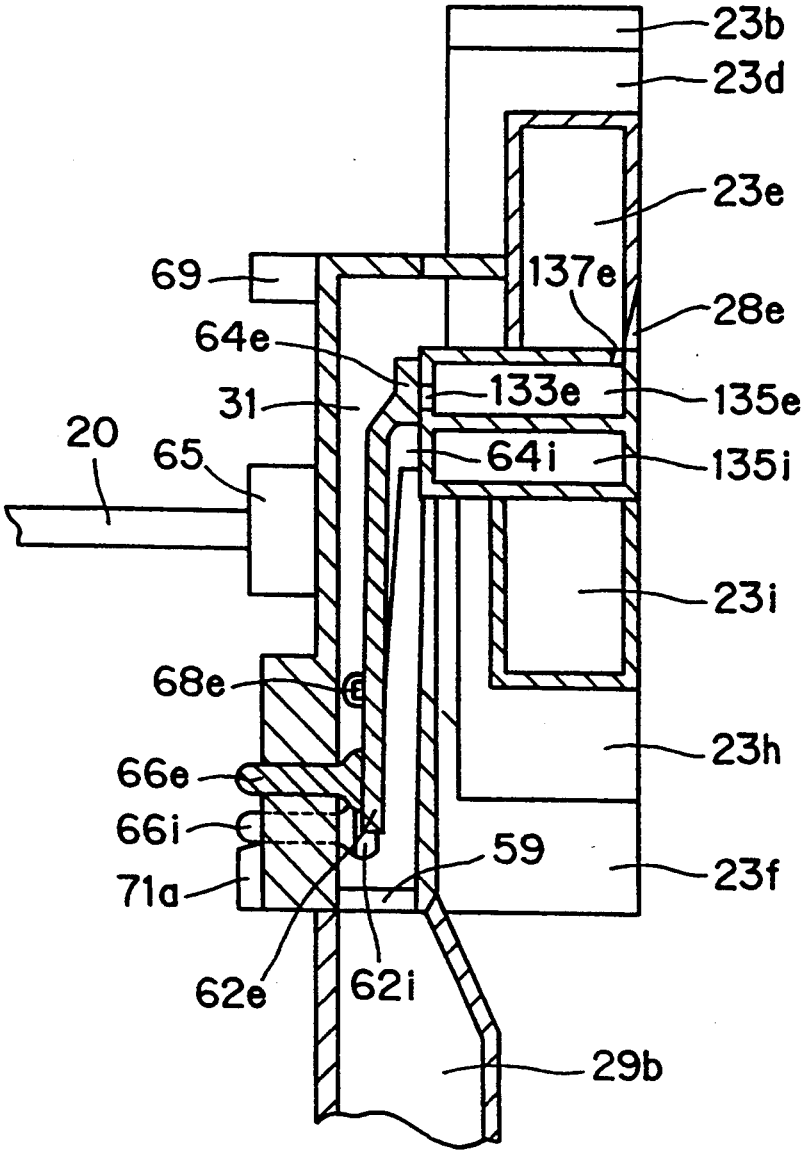
FIG. 6 is a partial sectional view of the music box shown in FIG. 1 from which the disk is removed.

FIG. 5 is a partial perspective view of the music box 10 from which the disk 21 is removed and FIG. 6 is a sectional view of the music box under such a condition.

A first wind trunk 29*a* communicates with a second wind trunk 29*b* located between the frames 13 and 15 through a hole 30 (FIGS. 2, 9) made on the frames 15. The second wind trunk 29*b* is laid in the back of the disk 21, communicating with a wind chest 31 provided so that it protrudes from the front face of the flute unit 23 through a hole 59 provided on the bottom of the chest 31.

Because the respective flutes and the wind chests communicating with each flute have substantially the same construction, the description below is performed regarding the flutes 23*e*, 23*i*, the upper wind chest 135*e* and the lower wind chest 135*i*.

Referring to FIG. 6, the wind chest 31 has a horizontally long rectangular parallelpiped space which is provided on the front face of the flute unit. This space is surrounded by a front wall of the flut unit 23, a rear wall in which the wind inlet hole 133*e* of the upper wind chest 135*e* is open of the flute unit 23, upper and lower walls and both side walls.

In the wind chest 31, nine valve units (62*a*, . . . , and 62*i*) are disposed. As shown in FIG. 6, the valve unit 62*e* is a long narrow member having a valve 64*e* for blocking the wind inlet hole 133*e* to the upper chest 135*e*. The valve unit 62*e* is rotatable with respect to a rotating shaft 68*e*. Because the center of gravity of the valve 64*e* is located to the right (with respect to FIG. 6) of a fulcrum 68*e*, gravitation is applied to the right of the fulcrum 68*e*. Thus the valve 64*e* usually blocks the wind inlet hole 133*e*. A valve 64*i* of a valve 62*i* unit blocks the wind inlet (not shown) of the lower chest 135*i*.

The spindle 20 for rotatably supporting the disk 21 protrudes outwardly from the front wall of the wind chest 31. A circular protruding plate 65 for receiving the disk 21 is provided at the root of the shaft 20. The front wall below the shaft 20 is formed so as to have a larger thickness. Nine through holes are provided side by side in the thick front wall and key members 66*e*, 66*i* are fit so that they are horizontally slidable. The front ends of the key members 66*e*, 66*i* protrude outwardly and the rear end of the key members 66*e*, 66*i* are in contact with the other ends of the aforementioned valve units 62*e*, 62*i*. The key members 66*e*, 66*i* are capable of moving back and forth in parallel to each other stably because the holes on the front wall are made to have a large thickness.

A protrusion 69 is formed above the shaft 20 and protrusions 71*a*, 71*b* are provided on the bottoms of the right and left ends of the thick front wall. The protrusions 69, 71*a*, 71*b* and the circular protruded plate 65 contact the disk 21, holding the disk 21 vertically.

The distances between the front ends of the key members 66*a*, . . . 66*e*, 66*f*, . . . , and 66*i* and the axis of the shaft 20 in the disk are all different. The distance between the projection 22 of the disk 21 and the center of the disk 21 is the same as the aforementioned distance between the axis of the key member which contacts the valve unit for blocking the wind inlet hole 133*e* leading to the mouth for generating a sound.

Figure 7:
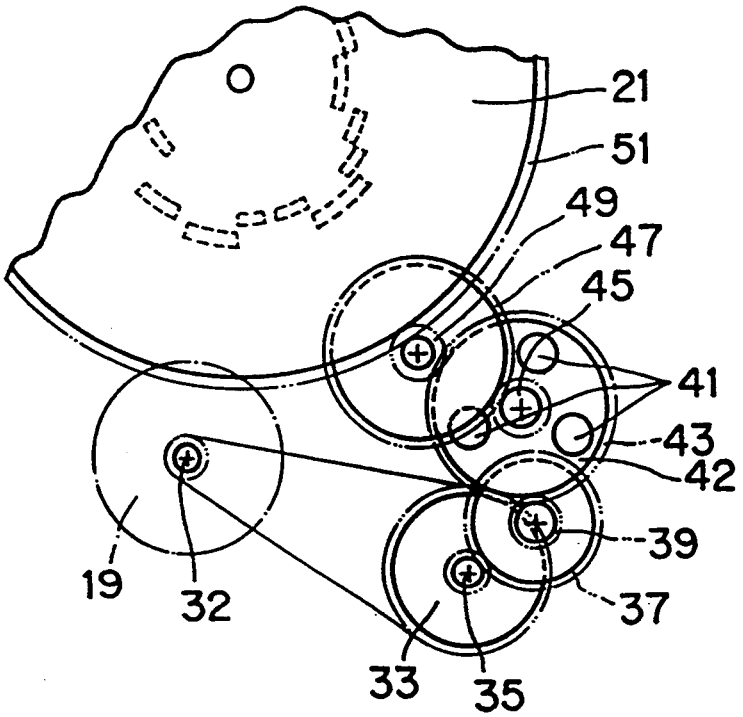
FIG. 7 is a drawing showing the gear train of the music box shown in FIG. 1.

FIG. 7 shows the mesh of the gear train.

A pulley 32 mounted on the spindle 27A of the motor 19 interlocks with a pulley 33 and a small gear 35 integrated with the pulley 33 meshes with a reduction gear 37. A small gear 39 integrated with the gear 37 meshes with threads 43 formed on the periphery of a disk 42. The disk 42 has three holes which are provided radially with respect to the rotation axis at every 120 degrees. A small gear 45 integrated with the disk 42 meshes with a gear 47 and a small gear 49 integrated with the gear 47 meshes with threads 51 formed on the periphery of the disk 21.

Figure 8:
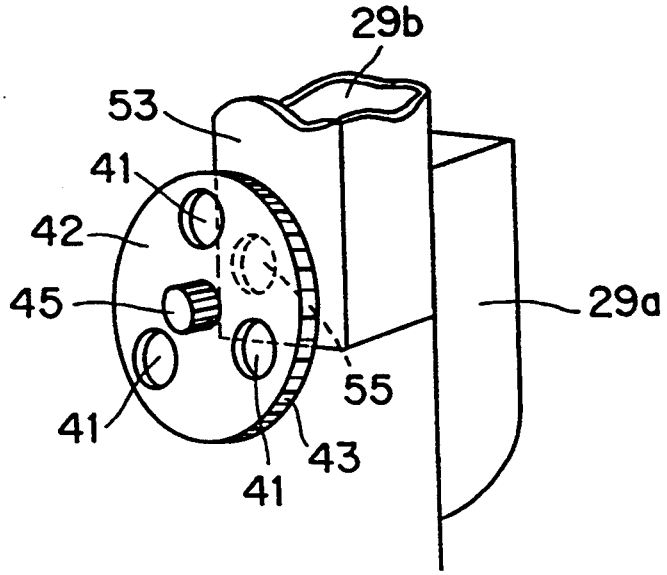
FIG. 8 is a perspective view showing the relation between a disk having holes and a hole in the wind trunk wall.
Figure 9:
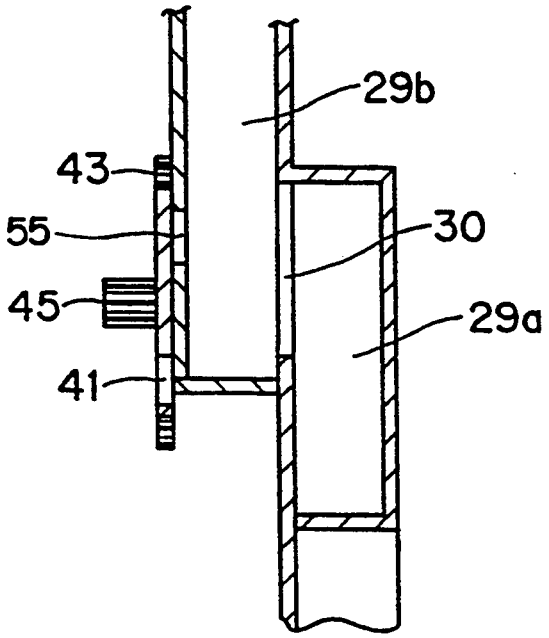
FIG. 9 is a sectional view showing the relation between a disk having holes and a hole in the wind trunk wall.

FIG. 8 shows the relation between three holes 41 in the disk 42 and the second wind trunk 29*b*, and FIG. 9 is a sectional view of the related construction. This relation functions as a means for generating vibration of the sound by wind.

The disk having holes 42 rotates so that it keeps contact with the front wall of the second wind trunk 29*b*. An air outflow hole 55 is formed in the front wall 53 of the second wind trunk 29*b*. As the disk 42 rotates, the air outflow hole 55 matches the three holes 41 in the disk 42 successively. Thus the air outflow hole 55 of the second wind trunk 29*b* is regularly opened and closed intermittently by the rotations of the disk having holes 42. When the air outflow hole 55 matches the hole 41, part of the wind passing through the second wind trunk 29*b* escapes outside, and when the air outflow hole 55 is blocked by the disk 42, no air escapes.

The air outflow hole 55 is set to an appropriate size in accordance with a balance between the average of the air spouting area of the flue 137*e* (the air spouting area differs depending on the musical scale of the flute) and the amount of air supplied from a blower unit.

Assuming that the size of the hole is the same, the amount of air escaping from the hole 55 increase when the wind is disturbed. It is possible to disturb the flow of wind by forming a wall with which wind collides in a wind trunk near the hole 55. In the present embodiment, the wind trunk 29*a* is connected to the wind trunk 29*b* so as to refract the wind-path making wind to collide with the front wall 53 of the wind trunk 29*b*.

In the operation of the music box, when the switch 25 is placed in the "on" position the motor 19 rotates to turn the fan 27. The wind generated fan 27 is supplied to the wind chest 31 through the wind trunks 29*a*, 29*b*. On the other hand, the rotations transmitted to the gear train including the pulley 33 interlocking with the spindle 27A of the motor 19 is decelerated to revolve the disk 42.

The frequency, of the air outflow hole 55 in the front wall 53 of the wind trunk 29*b* being opened by the three holes 41 in the disk 42, is 1/21–1/15 seconds, and preferably, 1/19–1/17 seconds. Wind (air) passing through the wind trunk 29*b* escapes outside at the above frequencies in order to vibrate wind pressure. Then, the vibrated wind is supplied to the wind chest 31.

The disk 21 is revolved by rotations ultimately decelerated by the gear train. The projection 22 on the back face of the disk 21 press the key member 66*e*, which connecting the valve unit 62*e* for blocking the wind inlet hole 133*e* of the wind chest 135*e*. Thus, The disc 21 communicates with the flue 137*e* of the flute 23*e* on a desired musical scale. Consequently, the key member 66*e* moves backward horizontally, pressing the other end of the valve unit 62*e*, so that the valve unit 62*e* is turned with respect to the rotating shaft 68*e*, lifting the valve 64*e* in order to open the wind inlet hole 133*e* in the wind chest 135*e*. In this process, wind of vibrated pressure is supplied from the flue 137*e*, so that the flute 23*e* generates a softly vibrating sound like tremolo.

Further, by providing a plurality of protrusions 22 on the disk 21 on a position which corresponds to the flute coinciding with a musical scale of a desired music, the music is played during a single rotation of the disk 21.

Although the embodiment described above has a construction in which individual wind chests which communicate with the respective flues are provided in order to generate a musical sound by selectively supplying wind to the wind chest, like a toy musical instrument disclosed in U.S. Pat. No. 4,185,533, it is also permissible to provide a construction in which the flues of the respective flutes are open to a common wind chest, the valve unit having the key member or the valve unit interlocking with the key member usually closing each wind inlet hole and selectively opening the same.

In the case that a product on which the music box of the present invention is mounted on a traveling toy which travels on rail as disclosed in U.S. Pat. No. 3,982,459, issued Sep. 28, 1976, it is possible to have a construction in which, by forming a plurality of protrusions in the positions corresponding to musical scales of a music on the rail, the protrusions press the key members of the valve units which block the wind inlet hole thereby moving the valve unit in order to selectively supply wind to each flute, playing a musical sound.

Figure 10:
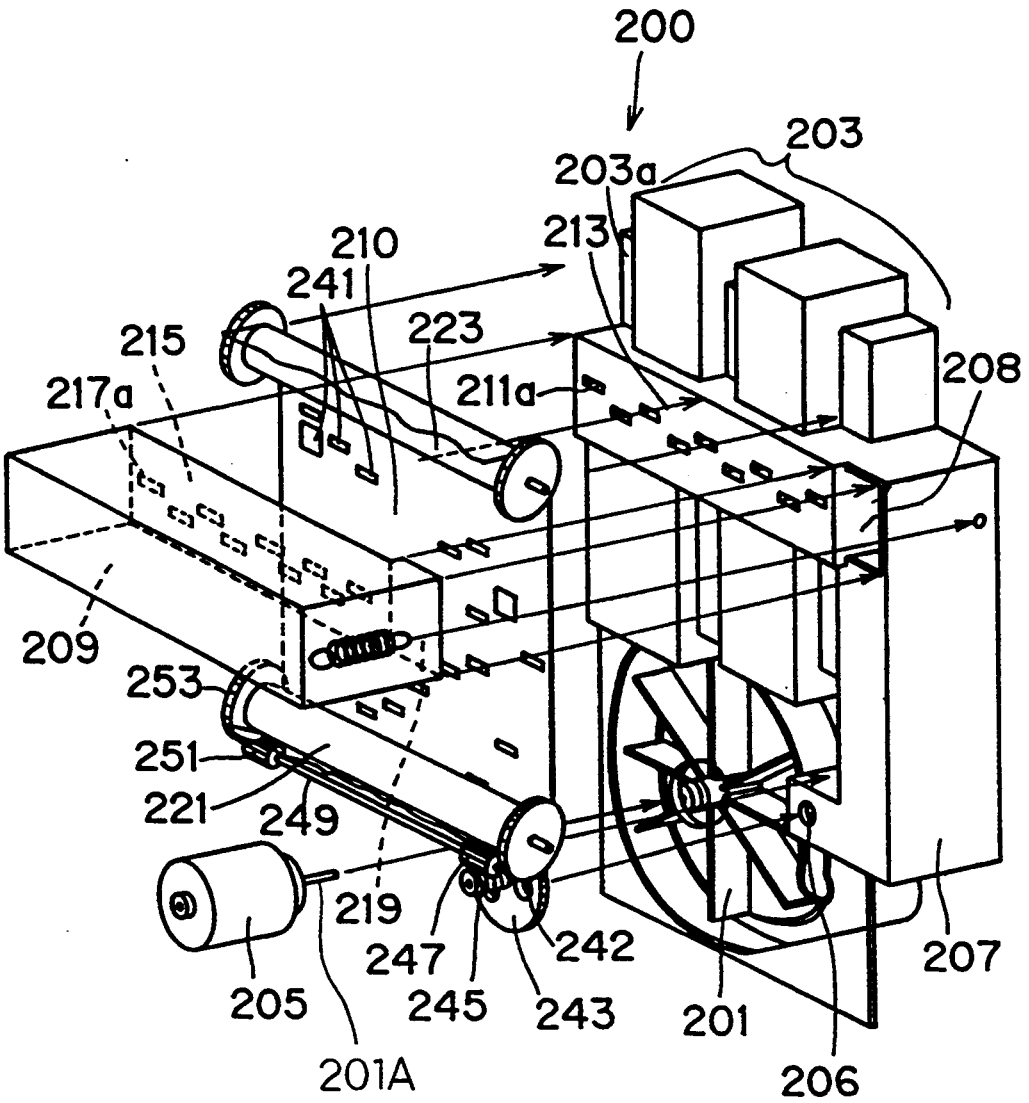
FIG. 10 is a partial disassembly drawing of another embodiment of the music box according to the present invention.

In FIG. 10, a wind feeding control means is a film member. The wind inlet holes of the wind chest are intercepted by the roll film and are selectively released.

Figure 11:
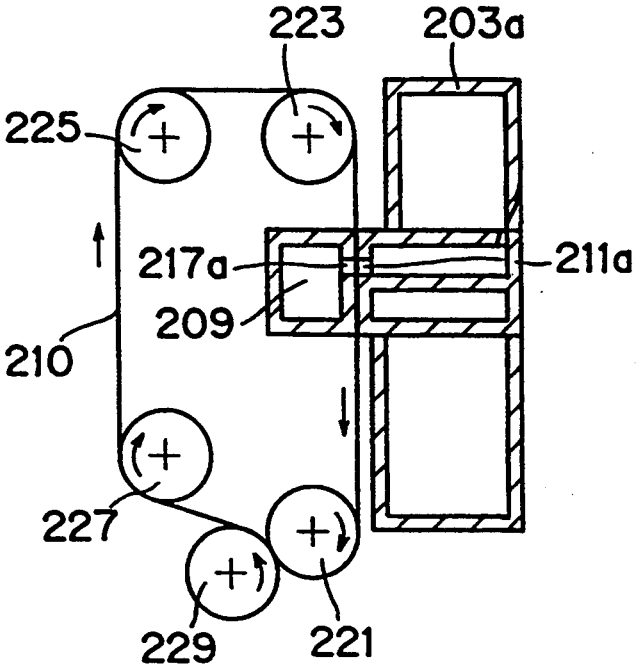
FIG. 11 is a partial sectional view of the music box shown in FIG. 10.

FIG. 10 is a disassembly drawing of the construction of the music box 200, part of which is omitted. FIG. 11 is a partial sectional view of the flute unit and the roller section showing the positional relationship between the wind inlet holes of the wind chests, roll film, and a roller for moving the film.

In a music box 200 including a wind feeding fan 201 and a flute unit 203 have the same construction as those of the music box 10 in FIG. 1. The gear train (not shown) driven by a motor 205 have the same construction as in the music box 10 except as specifically explained.

A wind trunk 207 is a wind way to flow air from the fan to the flutes and have a hole 206 (same as the hole 55 shown in FIG. 8) at the front wall. The trunk 207 extends to an opening hole 208 on the side of the flute unit 203. The opening hole 208 communicates with an opening hole 219 in the back wall of a wind trunk 209. The hole 219 is located in front of the flute unit 203.

A wind trunk 209 is a rectangular parallelpiped space and has wind outlet holes 217*a* on a vertical face 215. A face 213 have wind inlet holes 211*a* of respective wind chests of respective flutes as shown in FIG. 11. The opening hole 219 is provided so as to correspond to the opening hole 208 of the wind trunk 207 located on the right end of the music box 200.

A film 210 is an endless tape and is wide enough to intercept all the wind outlet holes 217 of the wind chest 209, having a plurality of holes 241. The film 210 is supported by four rollers 221, 223, 225, 227 (FIG. 11) and rotated by the roller 221. A roller 229 press the film 210 to feed the film 210 stably.

The film 210 is located between the face 213 of the wind chests and the face 215 of the wind chest 209 to block both the wind inlet holes 211 and the wind outlet holes 217.

The music box 200 also has the same gear train as in the music box 10. A disk 243 which is one of the gear train, having three holes 242 distributed at every 120 degrees, rotates along the front wall of the wind trunk 207 so that the holes 242 successively coincide with the hole 206 of the wind trunk 207.

A worm gear 245 meshing with a pinion 247 is mounted on the disk 243. The pinion 247 is fixed to an end of a shaft 249. The shaft 249 is placed along the roller 221. Another pinion 251 is fixed to the other end of the shaft 249. The pinion 251 meshes with a gear 253 which is provided on an end of the roller 221. Thus, when a motor 205 rotates, the roller 221 revolves at a decelerated speed.

The holes 241 in the film 210 make the wind outlet holes 217*a* communicate with the wind inlet holes 211*a*.

In the operation of the music box 200, wind generated by the fan 201 concerning the motor 205 is supplied to the wind chests 209. In the chest 209, the wind pressure is regularly changed intermittently by the rotation of the disk having holes 243 which opens and closes the air outflow hole 206. The film 210 are rotated by the roller 221. When the hole 241 in the film 210 coincides with the wind outlet holes 217*a* and the wind inlet holes 211*a*, wind is fed to a corresponding flute to generate a musical sound. The position of the hole 241 in the film changes successively when the film member 210 is moved. Consequently, the flutes for generating a musical sound are exchanged successively, the music box 200 play a melody.

In the embodiments described above, the pressure of wind introduced into the flute is repeatedly increased or decreased at predetermined intervals of time by the air outflow hole which is opened or closed regularly at a constant speed, the hole being provided in the wind chest. However, it is permissible to change the pressure of wind introduced into the flute regularly at a predetermined speed by any other method. As other means, it is possible to realize changes of wind pressure by providing another rotatable fan in the wind trunk.

In the music box according to the present invention, the air pressure in the wind chest leading from a blower unit to the flute is regularly increased or decreased at a predetermined speed. Thus, the tone of a sound generated by the flute is changed by the a wind pressure vibration generating means. Those sounds have a softly vibrating tone like a tremolo generated when a person plays a flute.

The music box of the present invention is preferable for mounting on toys or fancy goods because it is capable of generating beautiful sounds comfortable to a listener.

What is claimed is:

1. A music box comprising:

a blower unit having a fan connected to a spindle for producing wind in said blower unit a wind trunk connected to said blower unit for receiving wind from said blower unit;

a flute unit including a plurality of flutes each having a wind inlet hole and a mouth, and a wind chest connected to said wind trunk;

wind supply means for selectively opening said wind inlet holes to control flow of air from said wind chest to said plurality of flutes; and means for vibrating air pressure in said wind chest, said means for vibrating air pressure comprising a hole in a wall of said wind trunk and a rotating member having holes for opening and closing said hole in said wall of said wind trunk at a predetermined frequency, said rotating member with holes being driven by a gear connected to said spindle, said rotating member with holes being in contact with said wall of said wind trunk.

2. A music box according to claim 1, said predetermined frequency being substantially within a range of 1/19–1/17 seconds.

3. A music box according to claim 2, said wind supply means comprising a valve unit, said valve unit including a plurality of valves for blocking a corresponding wind inlet hole of said plurality of flutes, and a plurality of key members which protrude from a front wall of said wind chest.

4. A music box according to claim 3, said wind supply means further comprising a disk having a plurality of projections on a back surface for selectively hitting said key members, said disk being urged towards said front wall of said wind chest by a spring and being revolved by said gear.

5. A music box comprising:

a blower unit having a fan connected to a spindle for producing wind in said blower unit, said spindle connected to gear;

a wind trunk connected to said blower unit for receiving said wind from said blower unit, said wind trunk having an air outflow hole in a front wall;.

a flute unit including a plurality of flutes each having a wind inlet hole and a mouth, and a wind chest connected to said wind trunk;

a valve unit including a valve for blocking said wind inlet hole and a key member which protrudes from a front wall of said wind chest;

a disk having a projection on a back surface for hitting said key member, said disk having projections being urged towards said front wall of said wind chest by a spring and being revolved by said gear; and a disk having holes in contact with said front wall, and being driven by said gear.

6. A music box comprising:

a blower unit having a fan connected to a spindle for producing wind in said blower unit a wind trunk connected to said blower unit for receiving wind from said blower unit;

a flute unit including a wind chest connected to said wind trunk, and a plurality of flutes each having a wind inlet hole and a mouth;

a roll film unit comprising an elongated film member for intercepting a front face of said wind chest and movable along a direction of elongation of said film member, said film member having a plurality of holes for selectively opening said wind inlet hole of each flute; and means for vibrating air pressure in said wind chest, said means for vibrating air pressure comprising a hole in a wall of said wind trunk and a rotating member having holes for opening and closing said hole in said wall of said wind trunk at a predetermined frequency, said rotating member with holes being driven by a gear connected to said spindle, said rotating member with holes being in contact with said wall of said wind trunk.

7. A music box according to claim 6, said predetermined frequency being substantially within a range of 1/19–1/17 seconds.

* * * * *